US011844976B2

(12) United States Patent
Krauser

(10) Patent No.: US 11,844,976 B2
(45) Date of Patent: Dec. 19, 2023

(54) FITNESS APPARATUS AND METHOD

(71) Applicant: Christopher Allan Krauser, Canoga Park, CA (US)

(72) Inventor: Christopher Allan Krauser, Canoga Park, CA (US)

(73) Assignee: Christopher Allan Krauser, Canoga Park (CA)

( * ) Notice: Subject to any disclaimer, the term of this patent is extended or adjusted under 35 U.S.C. 154(b) by 9 days.

(21) Appl. No.: 17/347,006

(22) Filed: Jun. 14, 2021

(65) Prior Publication Data

US 2022/0395719 A1 Dec. 15, 2022

(51) Int. Cl.
*A63B 22/00* (2006.01)
*A63B 21/04* (2006.01)
(Continued)

(52) U.S. Cl.
CPC ..... *A63B 22/001* (2013.01); *A63B 21/00069* (2013.01); *A63B 21/0083* (2013.01);
(Continued)

(58) Field of Classification Search
CPC . A63B 21/04; A63B 21/0407; A63B 21/0414; A63B 21/0421; A63B 21/4027; A63B 21/4033; A63B 21/4034; A63B 21/4035; A63B 21/00047; A63B 21/02; A63B 21/021; A63B 21/022; A63B 21/023; A63B 21/00069; A63B 21/0083; A63B 21/0428; A63B 21/158; A63B 21/159; A63B 21/15; A63B 21/08; A63B 21/151; A63B 22/001; A63B 22/0012; A63B 22/0005; A63B 2022/033; A63B 2022/0038; A63B 2022/0043; A63B 23/1209; A63B 23/1218; A63B 23/1227; A63B 23/1236; A63B 23/1245; A63B 23/1254; A63B 23/1263; A63B 23/1272; A63B 23/1281; A63B 2213/004; A63B 2230/04; A63B 21/008; A63B 21/0084; A63B 21/00845; A63B 21/0085; A63B 21/0087; A63B 21/0088; A63B 21/0089
(Continued)

(56) References Cited

U.S. PATENT DOCUMENTS 4,241,913 A * 12/1980 Zwayer ..... A63B 23/00 482/137
4,275,882 A * 6/1981 Grosser ..... A63B 21/4035 482/112

(Continued)

*Primary Examiner* — Loan B Jimenez
*Assistant Examiner* — Thao N Do
(74) *Attorney, Agent, or Firm* — Ferguson Case Orr Paterson

(57) ABSTRACT

A vertically oriented fitness apparatus utilizes a combination of upper and lower assemblies resistant to vertical motion when the user pushes and pulls against crossbar members of the assemblies vertically. In alternate embodiments of the apparatus, resistance is provided by a dual action dashpot such as an adjustable bidirectional hydraulic damping cylinder which may be used in combination with spring resistance elements. The user is thus able to perform strength training and fitness conditioning exercises for both upper and lower extremities, and their core simultaneously while using the apparatus.

22 Claims, 20 Drawing Sheets

(51) Int. Cl.
*A63B 21/00* (2006.01)
*A63B 21/008* (2006.01)

(52) U.S. Cl.
CPC ..... *A63B 21/0428* (2013.01); *A63B 21/4034* (2015.10); *A63B 21/4035* (2015.10); *A63B 22/0005* (2015.10); *A63B 2213/004* (2013.01); *A63B 2230/04* (2013.01)

(58) Field of Classification Search
USPC ..... 482/112
See application file for complete search history.

(56) References Cited

U.S. PATENT DOCUMENTS 4,357,010 A * 11/1982 Telle ..... A63B 21/4047 482/97
4,397,462 A * 8/1983 Wilmarth ..... A63B 21/0087 482/137
4,667,955 A * 5/1987 Giesch ..... A63B 21/00072 482/137
4,838,543 A * 6/1989 Armstrong ..... A63B 22/0056 482/53
4,846,458 A * 7/1989 Potts ..... A63B 21/4034 482/901
4,848,739 A * 7/1989 Schaub ..... A63B 21/00072 482/113
4,911,436 A * 3/1990 Lighter ..... A63B 21/4047 482/138
4,982,952 A * 1/1991 Wang ..... A63B 23/03583 482/53
4,989,858 A * 2/1991 Young ..... A63B 21/4047 482/53
5,037,090 A * 8/1991 Fitzpatrick ..... A63B 23/12 482/142
5,062,627 A * 11/1991 Bingham ..... A63B 22/0056 482/53
5,071,115 A * 12/1991 Welch ..... A63B 22/0056 482/53
5,129,450 A * 7/1992 Hung ..... A63B 21/00072 482/53
5,129,872 A * 7/1992 Dalton ..... A63B 22/0056 482/52
5,145,476 A * 9/1992 Chiarello ..... A63B 22/0056 482/53
5,180,353 A * 1/1993 Snyderman ..... A63B 22/0056 482/53
5,183,448 A * 2/1993 Wang ..... A63B 22/0056 482/52
5,188,577 A * 2/1993 Young ..... A63B 22/0076 482/53
RE34,212 E * 4/1993 Potts ..... A63B 23/03525 482/41
5,277,677 A * 1/1994 Terauds ..... A63B 22/0056 482/80
5,290,211 A * 3/1994 Stearns ..... A63B 22/001 482/53
5,318,490 A * 6/1994 Henderson ..... A63B 22/001 482/125
5,336,142 A * 8/1994 Dalebout ..... A63B 21/00072 482/52
5,336,146 A * 8/1994 Piaget ..... A63B 22/0292 482/52
5,352,171 A * 10/1994 Lin ..... A63B 23/12 482/142
5,362,297 A * 11/1994 Muir ..... A63B 23/12 482/137
5,364,326 A * 11/1994 Smith ..... A63B 21/4035 482/133
5,372,564 A * 12/1994 Spirito ..... A63B 23/03533 482/142
5,407,407 A * 4/1995 Lin ..... A63B 22/0056 482/53
5,419,748 A * 5/1995 Snyderman ..... A63B 21/00072 482/52
5,435,801 A * 7/1995 Hung ..... A63B 21/00072 482/52
5,439,432 A * 8/1995 Lundin ..... A63B 21/4047 482/52
5,439,433 A * 8/1995 Lundin ..... A63B 22/0056 482/52
5,492,518 A * 2/1996 Measom ..... A63B 21/4047 482/133
5,518,470 A * 5/1996 Piaget ..... A63B 22/001 482/53
5,622,527 A * 4/1997 Watterson ..... A63B 21/05 482/53
5,624,361 A * 4/1997 Lai ..... A63B 23/0233 482/130
5,634,870 A * 6/1997 Wilkinson ..... A63B 23/1263 482/52
5,653,667 A * 8/1997 Reyes ..... A63B 21/4034 482/121
5,669,856 A * 9/1997 Liu ..... A63B 22/0292 482/52
5,685,810 A * 11/1997 Chung ..... A63B 21/00072 482/100
5,702,329 A * 12/1997 Koenig ..... A63B 23/0405 482/137
5,733,229 A * 3/1998 Dalebout ..... A63B 21/154 482/136
5,762,587 A * 6/1998 Dalebout ..... A63B 21/00069 482/52
6,102,833 A * 8/2000 Chen ..... A63B 22/0066 482/52
6,290,630 B1 * 9/2001 Boland ..... A63B 21/4035 482/121
6,544,147 B1 * 4/2003 Wang ..... A63B 22/0235 482/54
7,811,214 B1 * 10/2010 Danowski ..... A63B 23/1263 482/111
9,072,936 B1 * 7/2015 Miller ..... A63B 22/04
2004/0116258 A1 * 6/2004 Hyder ..... A63B 21/00072 482/96
2004/0157707 A1 * 8/2004 Yang ..... A63B 22/0056 482/53
2004/0250618 A1 * 12/2004 Keiser ..... A63B 24/00 600/587
2005/0079959 A1 * 4/2005 Wu ..... A63B 22/04 482/53
2005/0137068 A1 * 6/2005 Boland ..... A63B 21/4031 482/121
2006/0084555 A1 * 4/2006 Garner ..... A63B 21/159 482/112
2006/0160678 A1 * 7/2006 Franklin ..... A63B 21/4047 482/92
2007/0129223 A1 * 6/2007 Kolomeir ..... A63B 21/0087 482/112
2007/0232464 A1 * 10/2007 Chu ..... A63B 21/4047 482/96
2007/0287617 A1 * 12/2007 Teng ..... A63B 21/4035 482/126
2008/0004163 A1 * 1/2008 Husted ..... A63B 22/0056 482/57
2008/0280733 A1 * 11/2008 Dickie ..... A63B 22/001 482/52
2009/0088303 A1 * 4/2009 Footnick ..... A63B 21/00072 482/92
2009/0312161 A1 * 12/2009 Nohejl ..... A63B 21/4047 482/94
2010/0216600 A1 * 8/2010 Noffsinger ..... A63B 23/12 482/5
2010/0248916 A1 * 9/2010 Reyes ..... A63B 21/00072 482/130
2011/0287911 A1 * 11/2011 Reyes ..... A63B 21/4047 482/130
2011/0294630 A1 * 12/2011 Reyes ..... A63B 23/0405 482/121

(56) References Cited

U.S. PATENT DOCUMENTS

| | | | | |
|---|---|---|---|---|
| 2012/0238418 | A1* | 9/2012 | Reyes | A63B 21/00072 482/121 |
| 2012/0309598 | A1* | 12/2012 | Brentham | A63B 21/4035 482/112 |
| 2014/0073492 | A1* | 3/2014 | Hunter | A63B 21/0615 482/98 |
| 2016/0175645 | A1* | 6/2016 | Rayman | A63B 23/0494 482/142 |
| 2017/0065852 | A1* | 3/2017 | Cygan | A63B 21/4047 |
| 2020/0391068 | A1* | 12/2020 | McGraw | A63B 21/4035 |
| 2021/0205652 | A1* | 7/2021 | Chuang | A63B 21/00192 |
| 2022/0395719 | A1* | 12/2022 | Krauser | A63B 21/023 |

* cited by examiner

7/9

SECTION CC

Section AA

FITNESS APPARATUS AND METHOD

FIELD

The field of this disclosure relates generally to fitness equipment.

BACKGROUND

A longstanding problem in fitness conditioning is the lack of an effective means for simultaneously and efficiently strength training and fitness conditioning muscle groups from the arms, legs, torso, core and back.

DESCRIPTION

Disclosed is a vertically oriented fitness apparatus that utilizes a combination of upper and lower members resistant to vertical motion which the user pushes and pulls against vertically. In alternate embodiments of the apparatus, resistance is provided by one or more adjustable bidirectional hydraulic damping cylinders which may be used in combination with spring resistance elements. The user is thus able to perform strength training and conditioning exercises for both upper and lower extremities and their core simultaneously while using the apparatus.

In a basic embodiment of the apparatus, the apparatus can be broken down into a) an upper grasp bar (the upper cross bar), which the user holds onto; b) an upper control arm, which connects the upper control bar to an upper channel structure which restricts the control arm to slide vertically within a central beam or post without rotating; c) a lower foot-hold bar (lower cross bar), which includes a means for fixing a user's feet to the lower bar; d) a lower control arm, which connects the lower cross bar to an upper channel structure which restricts the control arm to slide vertically within a central beam or post without rotating; e) a resistance assembly, which includes one or more mechanisms for resisting vertical motion. (FIGS. 6A-9).

In an alternate embodiment of the apparatus, the control arms are fixed to the central post by a pivot point, the structure extending with portions connecting on one side of the pivot point to the upper or lower bar, and on the other side of the pivot point to the resistance assembly. (FIGS. 1-5B).

The resistance assembly typically comprises one or more velocity sensitive hydraulic damping devices such as an adjustable bidirectional hydraulic damping cylinder which acts to resist the vertical motion of the upper and lower bars and may include an integrated or inline spring tensioning component. An exemplar adjustable bidirectional hydraulic damping cylinder suitable for the disclosed apparatus is available from Quindao Huaruihengda Machinery Co. Ltd.—model YZB56-450, with a compressed length of 450 mm and an extension or stroke length of 240 mm. This exemplar model cylinder has an adjustable load force of 44.5 lbs to 444.9 lbs at a nominal velocity of 50 mm/sec. The exemplar adjustable damping cylinder is shows in FIG. 5C. These specifications are exemplar only, and for various embodiments of the apparatus a variety of compressed and extended damping device lengths, as well as resistance parameters and adjustment settings may be suitable.

By way of the above aspects of the basic apparatus design, the apparatus provides low impact even resistance-based fitness conditioning and strength training simultaneously to muscle groups in all four limbs, the torso and the core of the user.

A number of accessory components may be integrated to the apparatus as described below.

Figure 1:
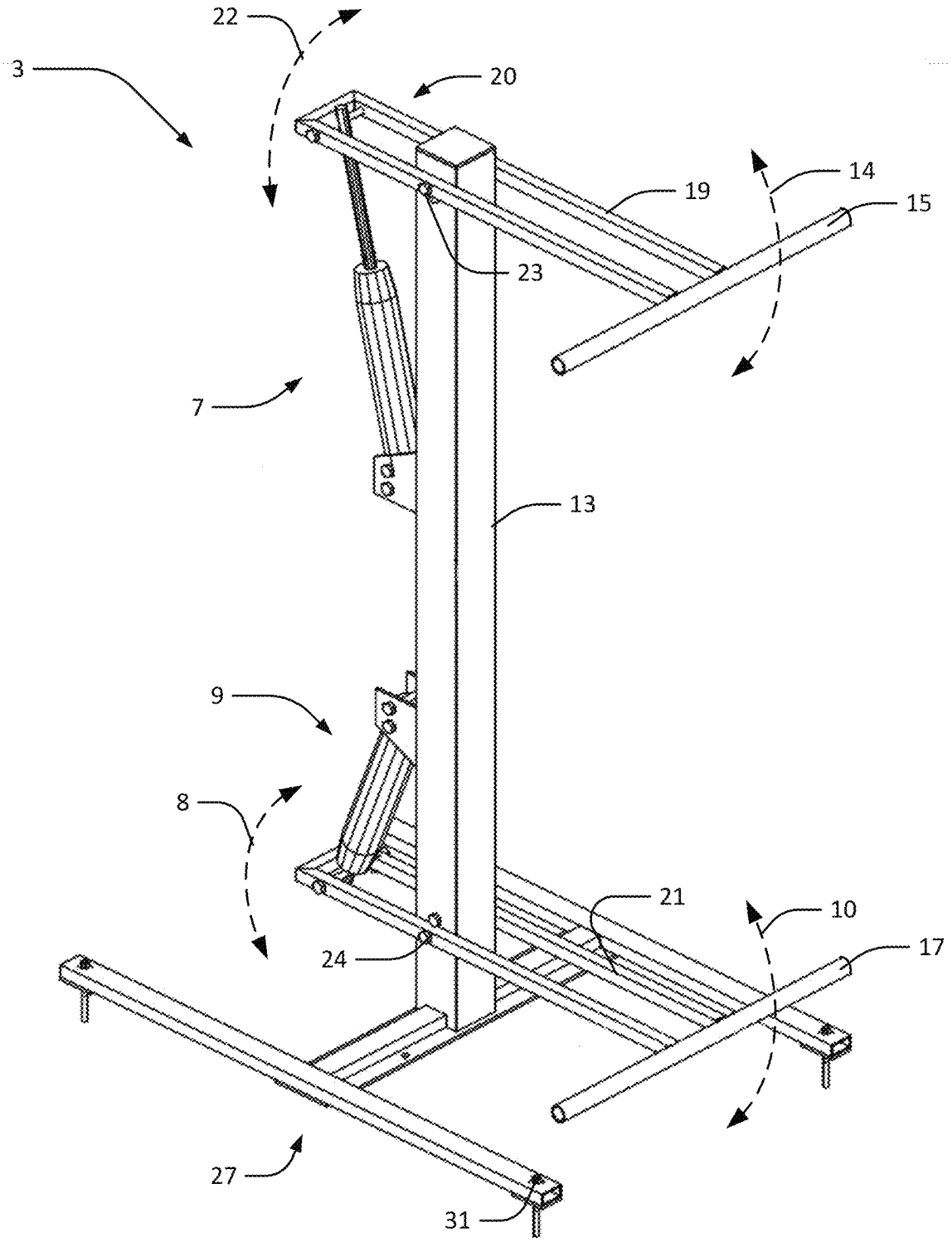
FIG. 1 shows a perspective view of the vertically oriented stand-up exercise apparatus with pivoting upper and lower control arms.

In an exemplar "pivot" version of the apparatus 3 shown in FIG. 1, the upper 15 and lower 17 cross-bars move in a vertically oriented arc 14 with a radius equal to the distance between the axial center of the cross bars and the center of the respective upper 23 and lower 24 pivot points, which are connected by the respective upper 19 and lower 21 control arms. The back end 20 of the upper control arm 15 travels in the opposite vertical direction 22, in an arc of radius distance between the pivot point and the resistance mount point on the upper resistance assembly. Similarly, the back end of the lower control arm 21 travels in the opposite vertical direction 8 of the user cross bar 17 in an arc of radius distance between the lower pivot point 24 and the resistance mount point on the lower resistance assembly 9. In this version, upper and lower resistance assemblies 7 9 comprise linear dual linear hydraulic damping component. These resistance components generally operate using the viscosity friction of the hydraulic fluid in the cylinder to generate velocity sensitive force (damping) during both the compression phase of the cylinder and the extension phase of the cylinder. Mechanically similar units are used in shock absorber applications. In alternate embodiments, the hydraulic damping device uses an ability to modify the internal hydraulic pathway to provide adjustable resistance damping. Such linear controllable hydraulic dampers are available commercially for example as described above. In other alternative embodiments, a spring is integrated into the resistance assembly to provide position-based resistance and to return the control arm to its resting position.

In this version of the apparatus, a base 27 for the apparatus is constructed of bar structures which fixed to the central column 13 and in this version, bolted 13 to the floor.

Figure 2A:
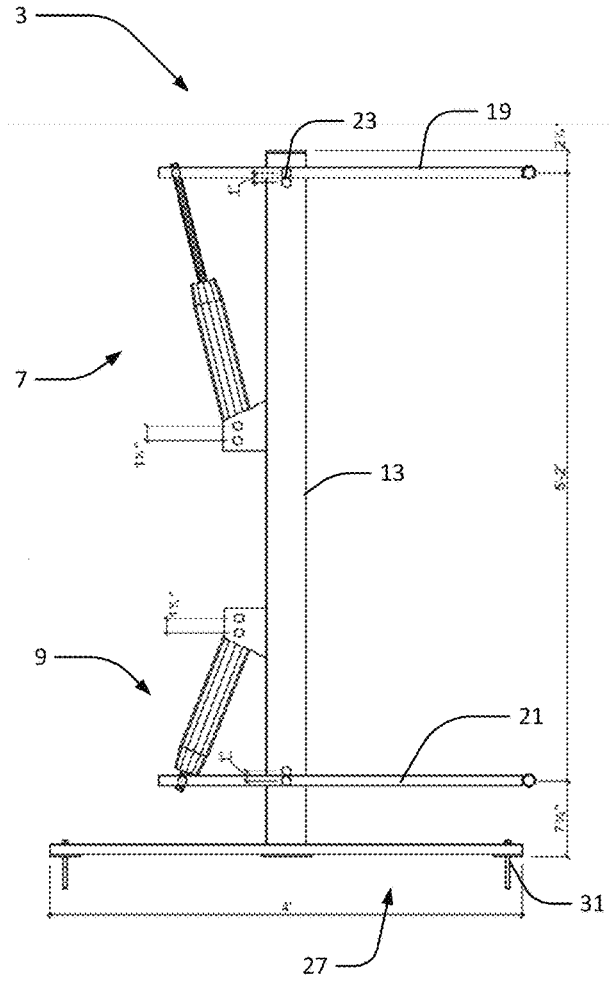
FIGS. 2A and 2B show the side view and back views of the apparatus embodiment from FIG. 1.
Figure 2B:
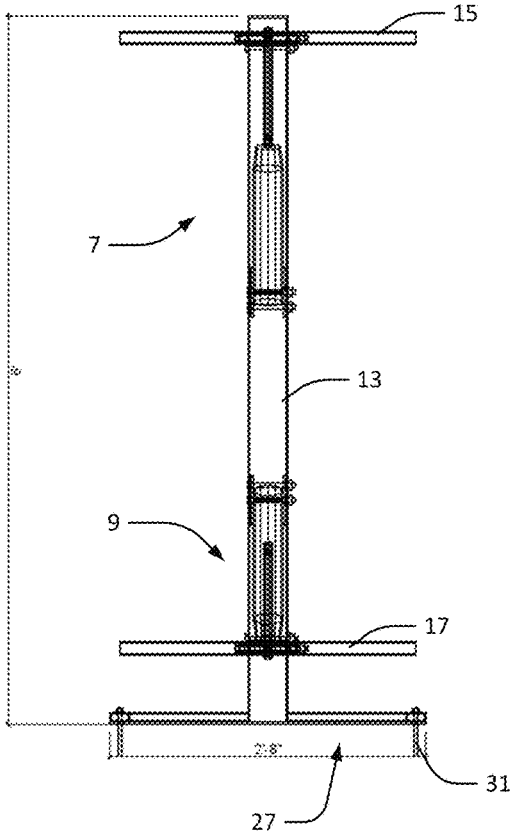

FIGS. 2A and 2B show the side and back views of the apparatus 3. In these views, the above described components may be viewed, including the upper 15 and lower 17 cross bars, the upper 19 and lower 21 control arms, the upper 7 and lower 9 resistance assemblies, the central column 13 and the base 27. Note that the dimensions shown in FIGS. 2A and 2B are exemplar for an operable embodiment of the apparatus and are in no way intended to be limiting.

Figure 3:
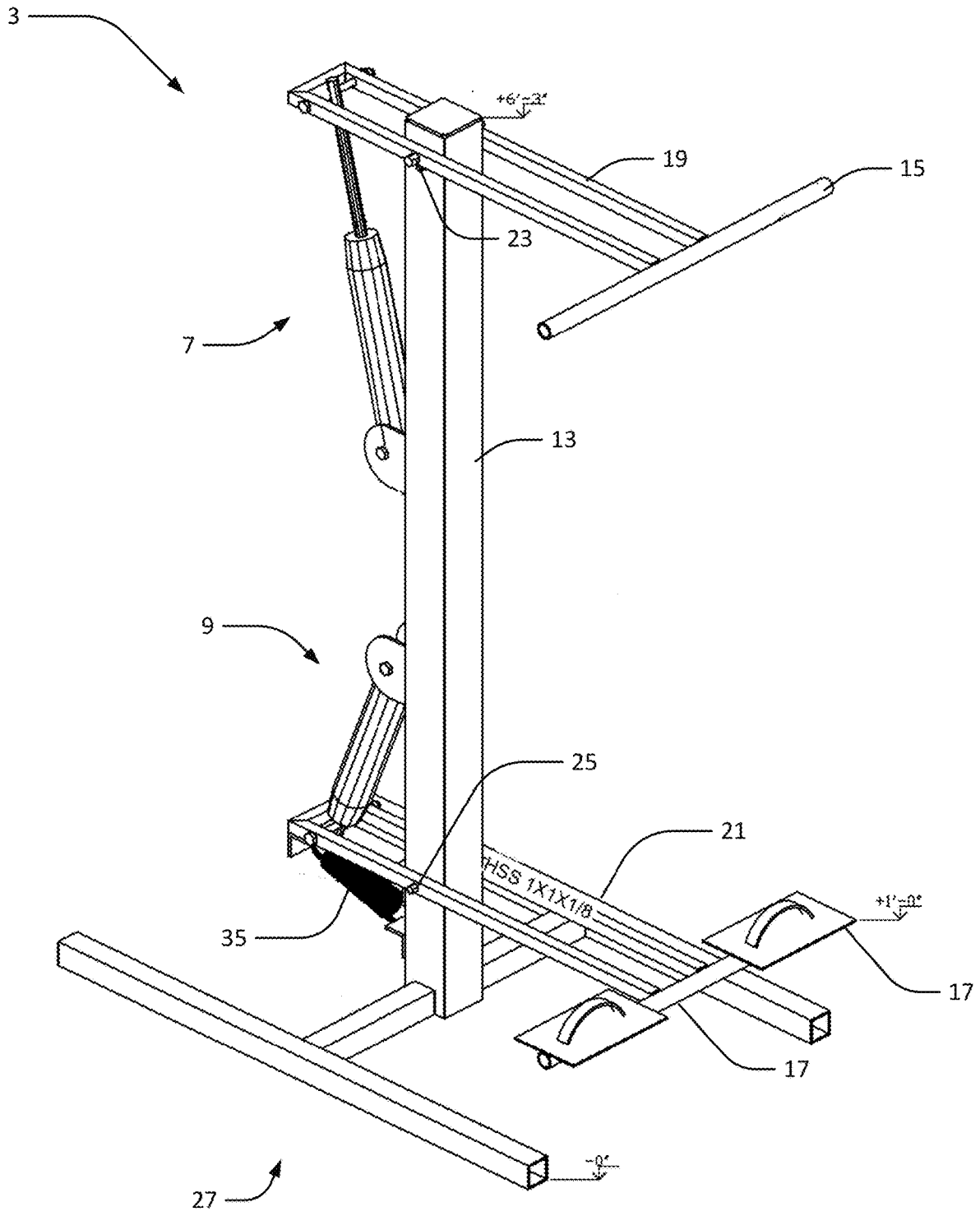
FIG. 3 depicts a version of the embodiment from FIG. 1 with an extension spring resistance element attached to the lower control arm.

FIG. 3 shows another version of the above apparatus 3 embodiment which includes an additional resistance component 35 attached to the lower control arm 21 attached to the back end of lower control and the central column, near the base 27. In alternate versions, the shown spring 35 is an extension spring which returns the lower control arm 21 and lower cross bar 17 to a resting position after using for exercise. In other versions of the apparatus, a spring member may be positioned inline with the hydraulic damper of upper 7 and lower resistance assemblies 9, similar to a vehicle component known as the Mcfearson strut, where the spring acts to both increase the resistance according to position rather than velocity, and also acts to return the control arm 19 21 and cross bar 15 17 to the resting position after use.

FIG. 3 also shows exemplar structural component sizes, also these are not essential to the present general apparatus indicated performance. Also shown in this figure are footholds 33 on the lower cross bar 17, which provide the user the ability to pull up on the lower bar with their feet and legs, providing strength training and fitness conditioning for leg and core muscles simultaneously with arm and torso muscles.

Figure 4A:
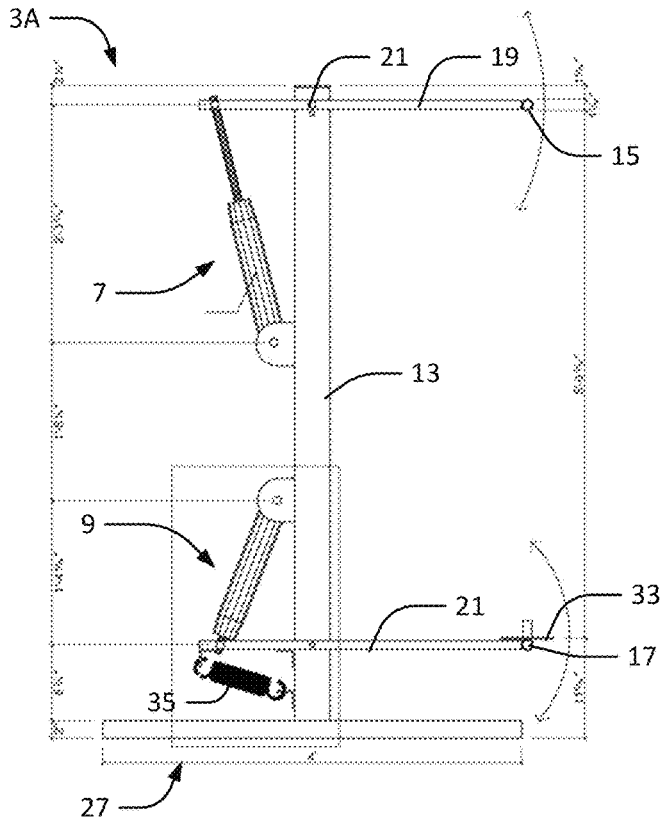
FIGS. 4A and 4B depict a side and a close-up view of the apparatus embodiment from FIG. 3.
Figure 4B:
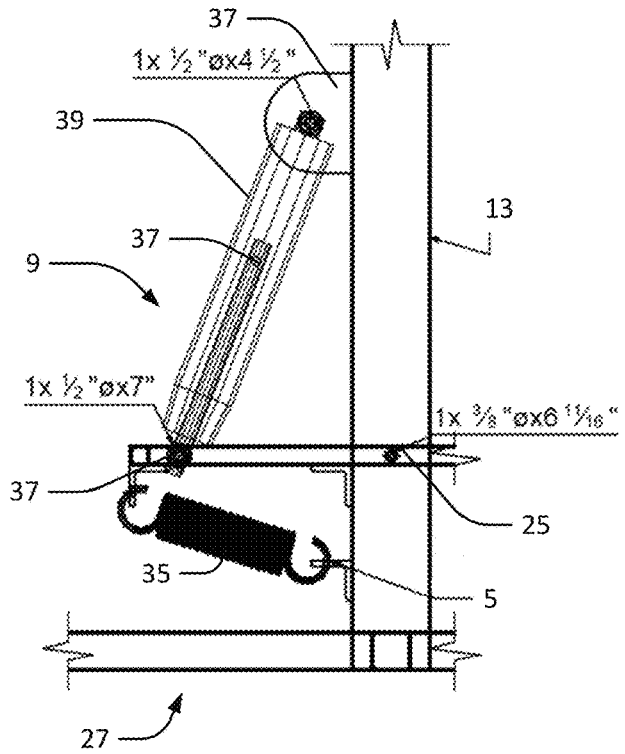

FIGS. 4A and 4B show a side view and side view close-up of the apparatus 3A from FIG. 3 which uses an extension spring 35 connected between the lower control arm 21 and an anchor point 5 on the central column 13. When this type of spring is used, the spring provides position-based resistance which pulls the lower control arm 21 downward, and the lower cross bar 17 upward, returning it to its resting position according to characteristics of the extension spring. In an exemplar embodiment, the extension spring 35 is available from the WB Jones Spring Co., and has dimensions 8.5 in.×2.25 in, which spring wire diameter of 0.28 in., with a safe deflection distance of 8.5 in. to 12.16 in. These specifications are exemplar only, and for various embodiments of the apparatus a variety of spring parameters may be suitable or preferred. In the close-up view of FIG. 4B, the cylinder housing 39 and piston rod 37 (inside the cylinder housing) components of the resistance assembly 9 are shown in the compressed position with the cylinder housing 39 affixed to the central column 13 at a connection pivot point 40 and the piston rod 38 affixed to the central column 13 at the connection pivot point 38. Note that the dimensions shown in FIGS. 4A and 4B are exemplar for an operable embodiment of the apparatus and are in no way intended to be limiting.

In other versions, a compression spring it used which provides position-based resistance in both extension and compression positions. Exemplar component measurement and sizes are shown in FIGS. 4A and 4B, which are not integral to the disclosed apparatus but are provided as an operative example which may be suitable for a variety of users. In various versions of the device, the extension spring 35 shown may be replaceable by an operator of the device to adjust the tension of the spring component.

Figure 5A:
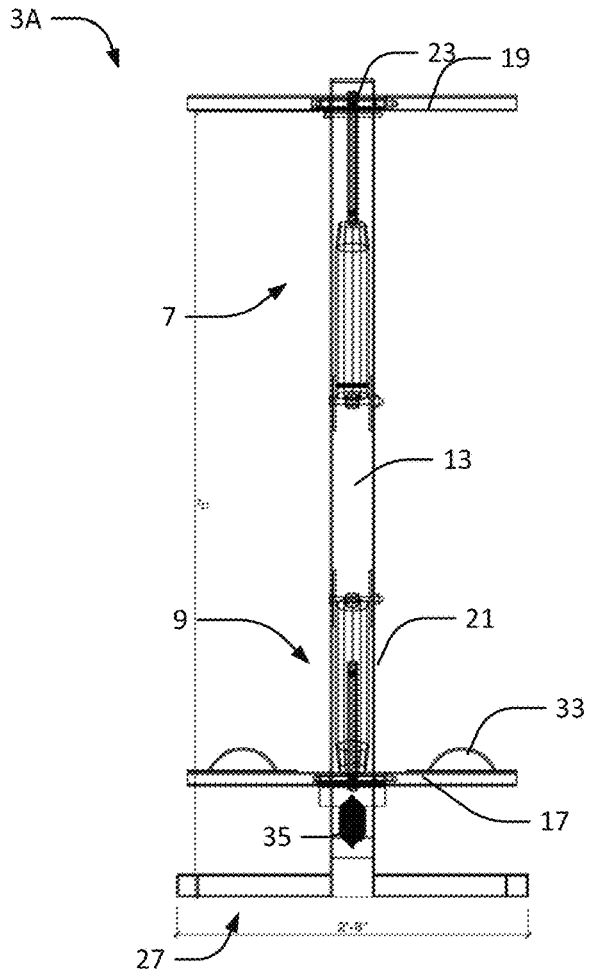
FIGS. 5A and 5B show the back and top view of the apparatus embodiment from FIG. 3.
Figure 5B:
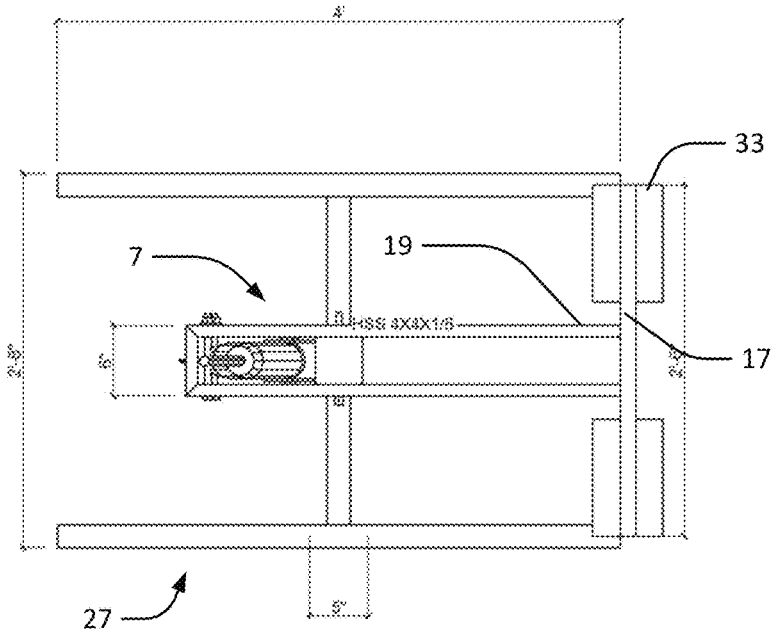

FIGS. 5A and 5B show front and top views of the apparatus from FIG. 3, showing exemplar component measurements.

Figure 5C:
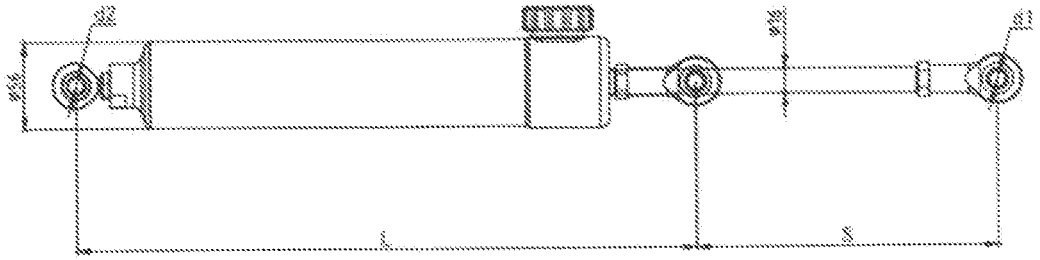
FIG. 5C shows an exemplar hydraulic bi-directional resistance component.

FIG. 5C shows an exemplar commercially available hydraulic bi-directional resistance component.

Figure 6A:
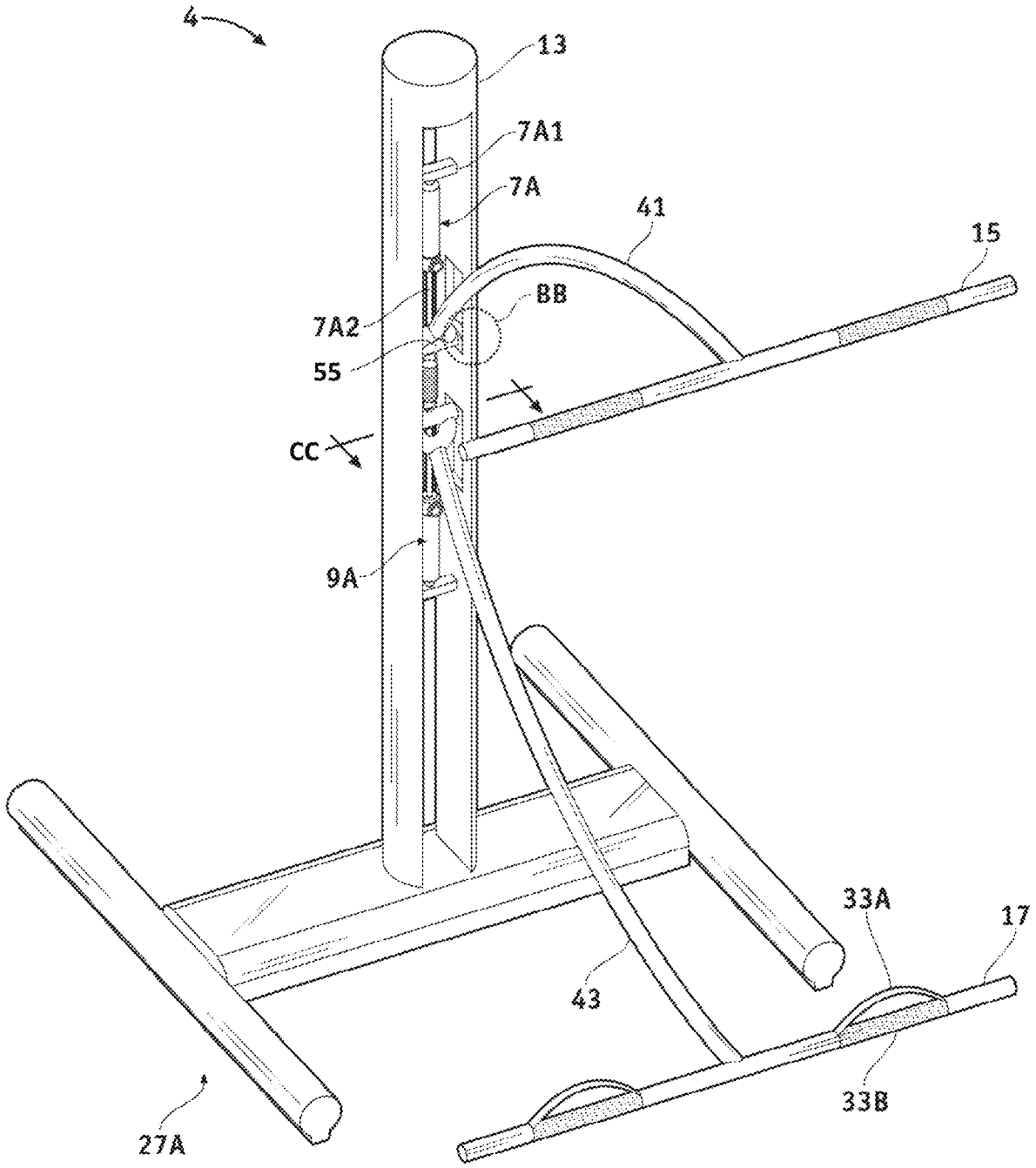
FIG. 6A shows a front perspective view of the vertically oriented stand-up exercise apparatus with vertically sliding upper and lower control arms.4

FIG. 6A shows a perspective view of an alternative embodiment of the apparatus 4 which utilizes a channel in the central column 13 to restrict motion of the upper 41 and lower 43 control bar structures vertically and to prevent rotation. The upper 41 and lower 43 control bars connect to the upper 15 and lower 17 cross bars, respectively, which may be connected to the control bar with a rotationally fixed connection. In the shown version, the resistance control assemblies 7A and 9A are housed within the central column shown in other figures. In various versions of this embodiment of the apparatus, the control arms may be of the arc shape and of the respective sizes as in the shown figure, or may be short arcs, disposed closer to the central post. Various components of the apparatus are shown in this view including the central column 13, base 27A, upper 41 and lower 43 control bars, upper 15 and lower 17 crossbars and the foot-rest 33B and foot-hold 33A. Cross-section CC is described below and shown in a subsequent drawing.

Figure 6B:
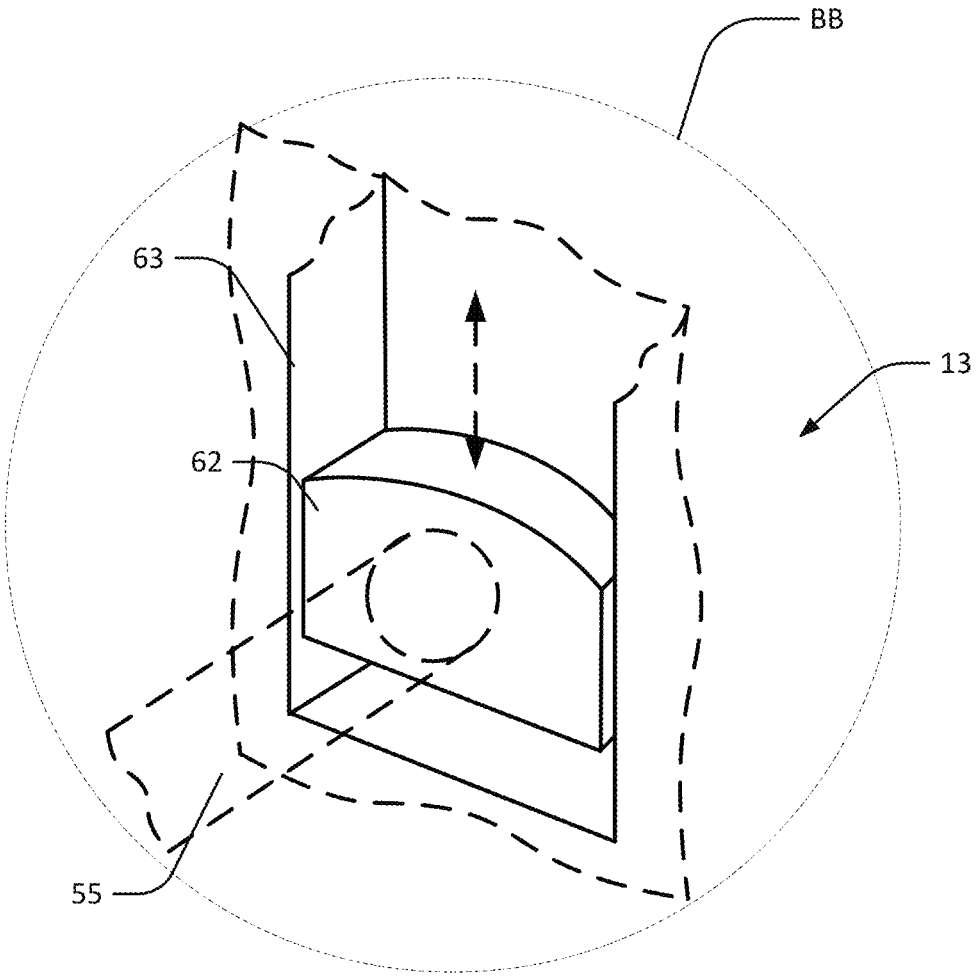
FIG. 6B shows a close-up view of inset BB from FIG. 6A showing the vertical slot and interface for the control bar.

FIG. 6B shows a close-up of inset BB from FIG. 6A showing the sliding bar ends 62 of control arm mount bar 55, located inside the central column 13. The sliding bar ends slide vertically within the control bar slots 63. Each sliding bar end 62 is prevented from rotating by its vertically oriented straight edges within the slot 63.

Figure 6C:
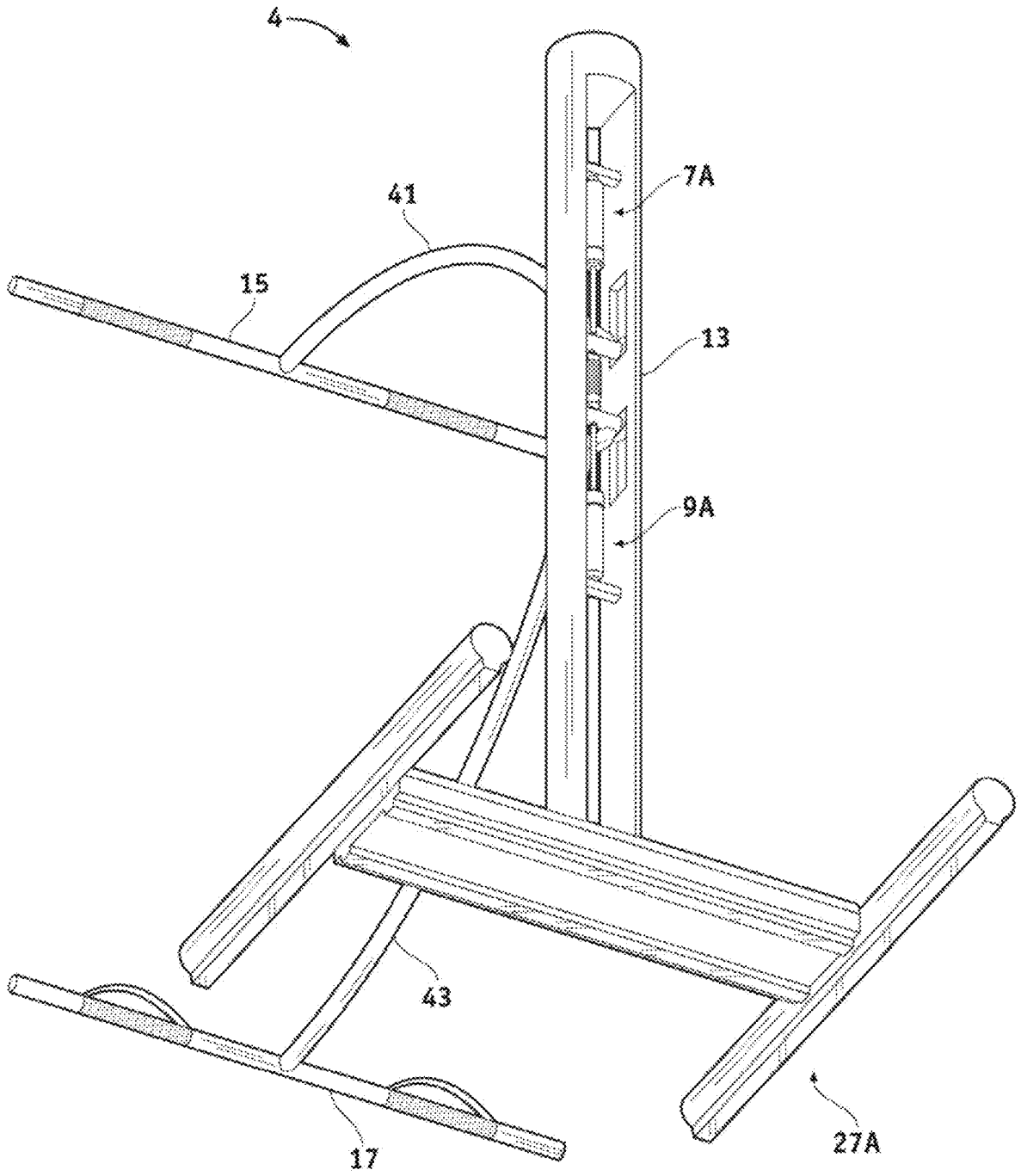
FIG. 6C shows a bottom perspective view of the apparatus embodiment from FIG. 6A.

FIG. 6C shows a perspective view from below the apparatus 4 in FIG. 6A showing various components of the apparatus, including the central column 13, base 27A, upper 41 and lower 43 control arms, upper 15 and lower 17 crossbars and the upper 7A and lower 9A resistance assemblies.

Figure 6D:
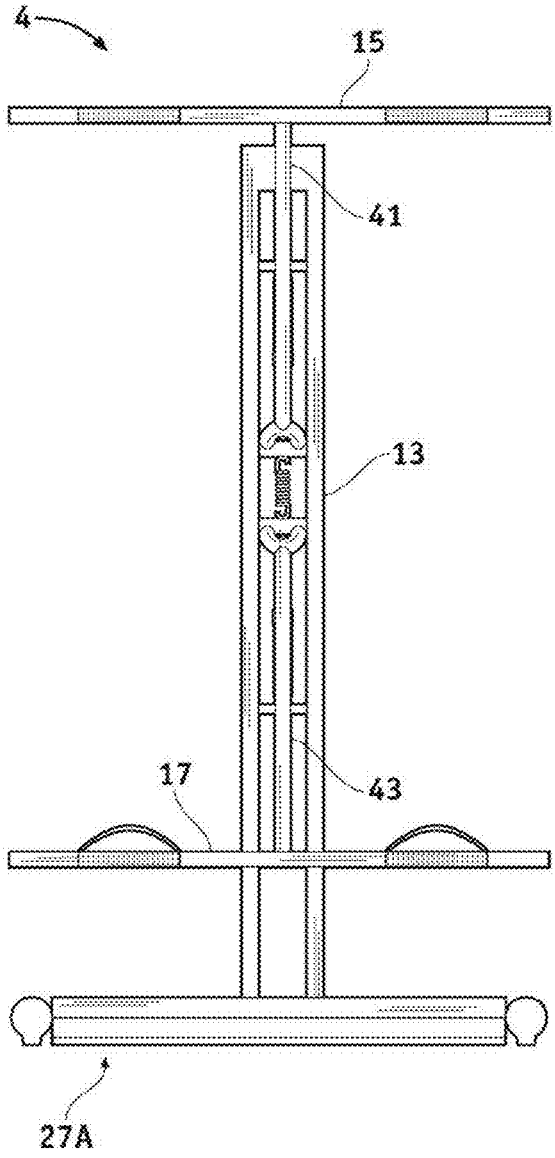
FIGS. 6D and 6E show the front and back views of the apparatus embodiment from FIG. 6A.
Figure 6E:
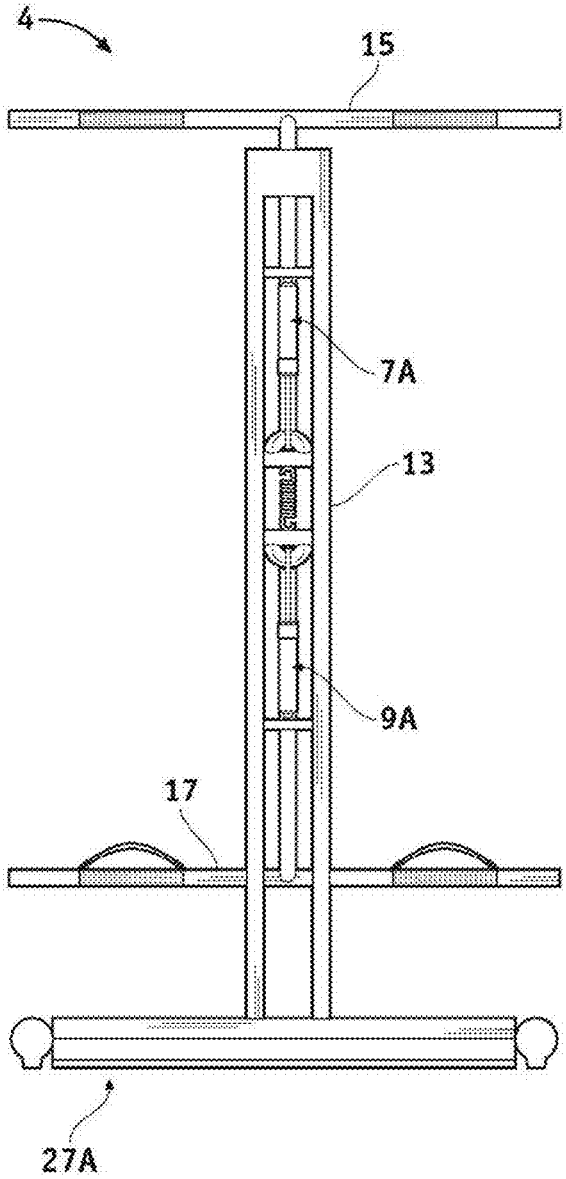

FIGS. 6D and 6E show front and back views of the apparatus 4 from FIG. 6A showing various components of the apparatus, including the central column 13, base 27A, upper 41 and lower 43 control arms, upper 15 and lower 17 crossbars and the upper 7A and lower 9A resistance assemblies.

Figure 6F:
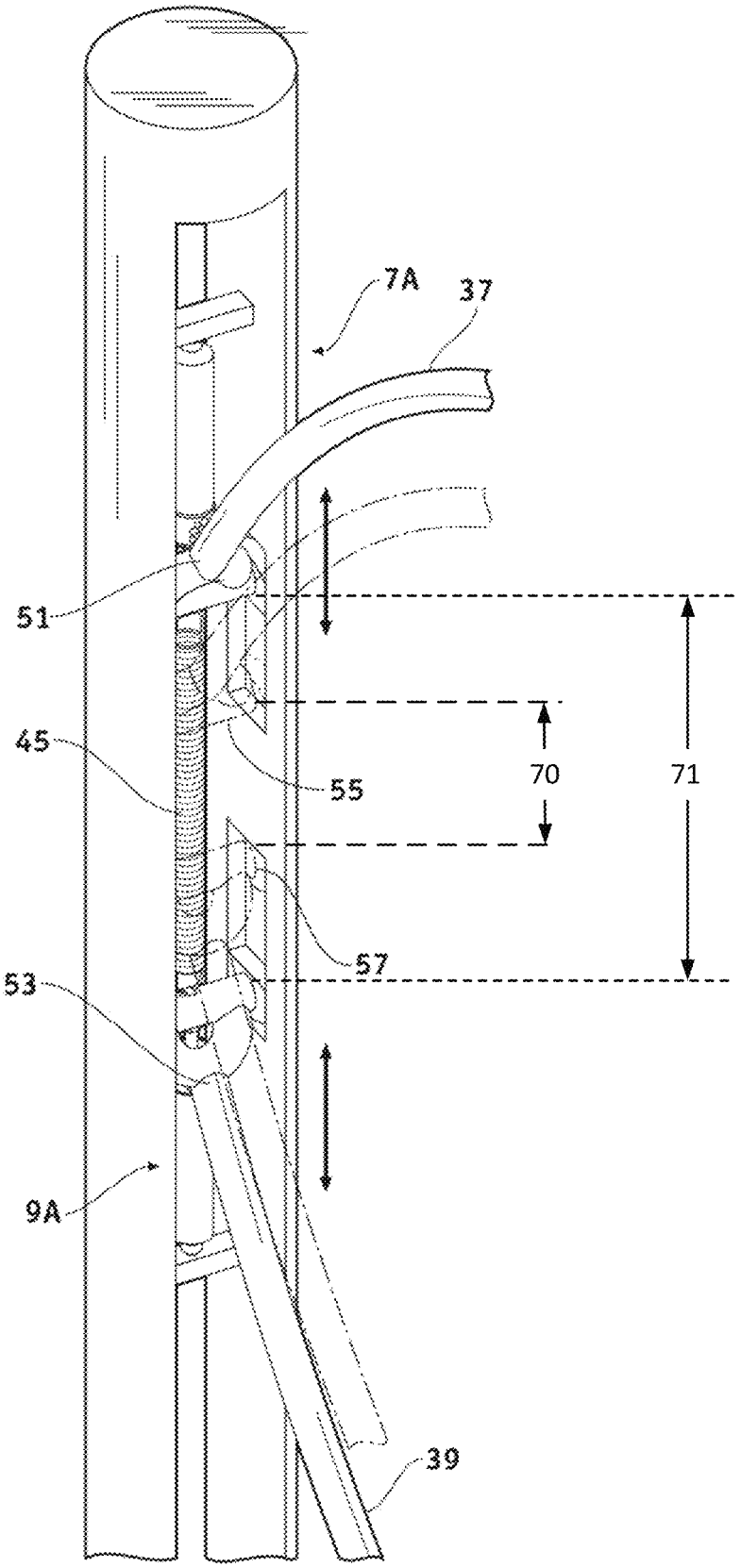
FIG. 6F shows a close-up view of the central column resistance assembly of the apparatus embodiment from FIG. 6A.

FIG. 6F shows a close-up of an exemplar resistance assembly for the apparatus from FIG. 6A. In this version, an extension spring 45 is utilized between the upper 41 and lower 43 control arms is attached to upper and lower control arm connection points and provides position or length based resistance which pulls the upper 51 and lower 53 control arm connection points. The extension spring 45 acts upon both the upper 41 and lower 43 control arms simultaneously to pull the control arms and affixed cross bars back to their resting position after fitness exercise use. Both upper and lower ends of the control arms slide vertically within their respective control grooves by the bar end structures shown in FIG. 6B which are connected to the respective control arm mount bars 55 and 57. Operating in conjunction with the resistance spring 45 are upper 7A and lower 9A dual action hydraulic damping resistance components, which provide velocity sensitive resistance for vertical motion of the upper and lower control arms and hence the upper and lower cross bars. These damping resistance components are housed in the central column 13. In various versions of this apparatus 4 embodiment, the extension spring may be substituted by the apparatus operator for springs of differing lengths and spring tensile strength. In various versions of this apparatus embodiment the damping resistance components may be operator adjustable for velocity sensitive damping resistance.

Figure 6G:
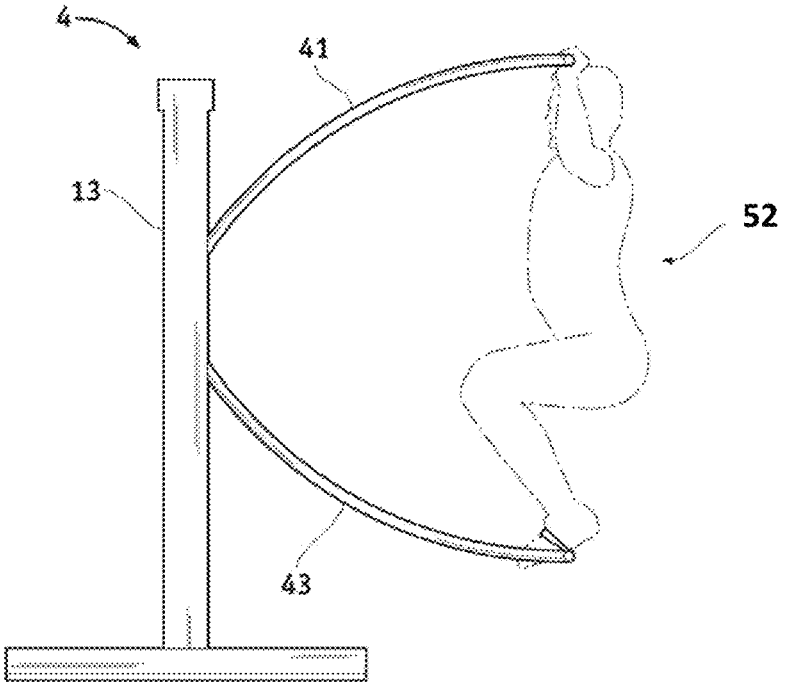
FIGS. 6G and 6H show a person using the fitness apparatus from the FIG. 6A embodiment in the extended and compressed positions, respectively.
Figure 6H:
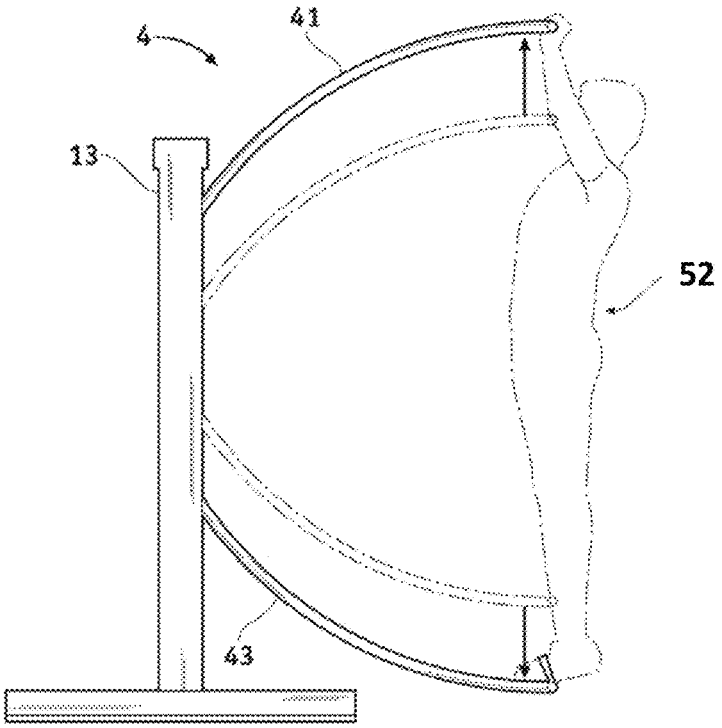

FIGS. 6G and 6H show a side view of the apparatus 4 from FIG. 6A during fitness conditioning and strength training use. As explained above and detailed below, the upper 41 and lower 43 control arms restrict motion to vertical sliding within a channel and restrict any rotation of the control arm. In FIG. 6G, the user 52 is shown with limbs in full extension while grasping the upper cross bar 15 and feet held in the foot holds 33A/33B attached to the lower cross bar 17. In FIG. 6H, the user 52 is shown with limbs in minimum extension while grasping the upper cross bar and feet held in the foot holds attached to the lower cross bar.

Figure 6I:
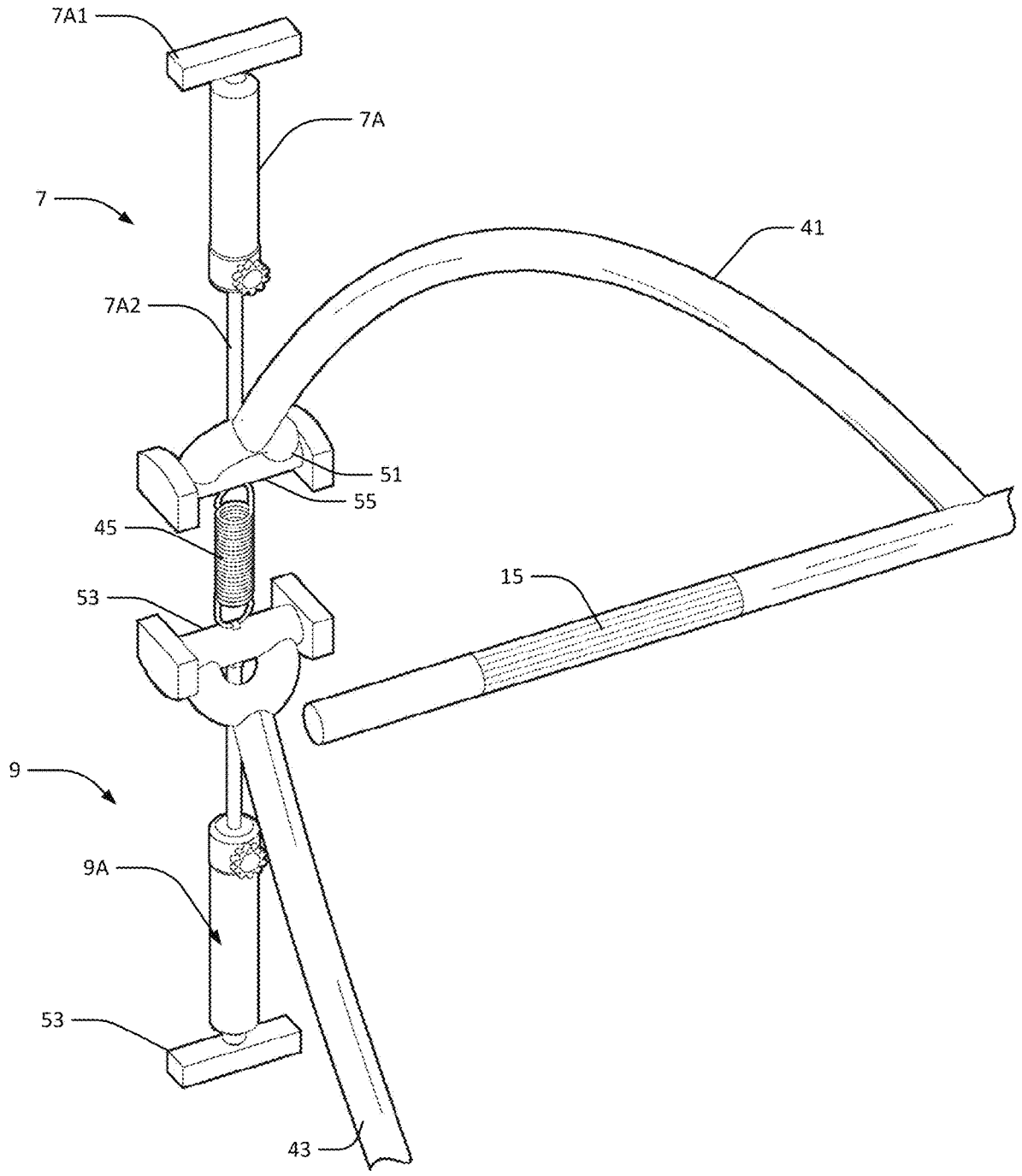
FIG. 6I shows a close-up view of the central column resistance assembly interior components of the apparatus embodiment from FIG. 6A.

In FIG. 6I the interior upper and lower resistance assemblies are shown in an exposed view without the central column frame. Various components of the resistance assemblies 7 and 9 are identified including the resistance housing 7A and 9A, resistance assembly mounts 7A1 and 9A1, resistance telescope 7A2 and 9A2. Also shown are the control arms 41 and 43, control arm mounts 51 and 53, control arm mount bars 55, and upper and lower grab bars 15.

Figure 6J:
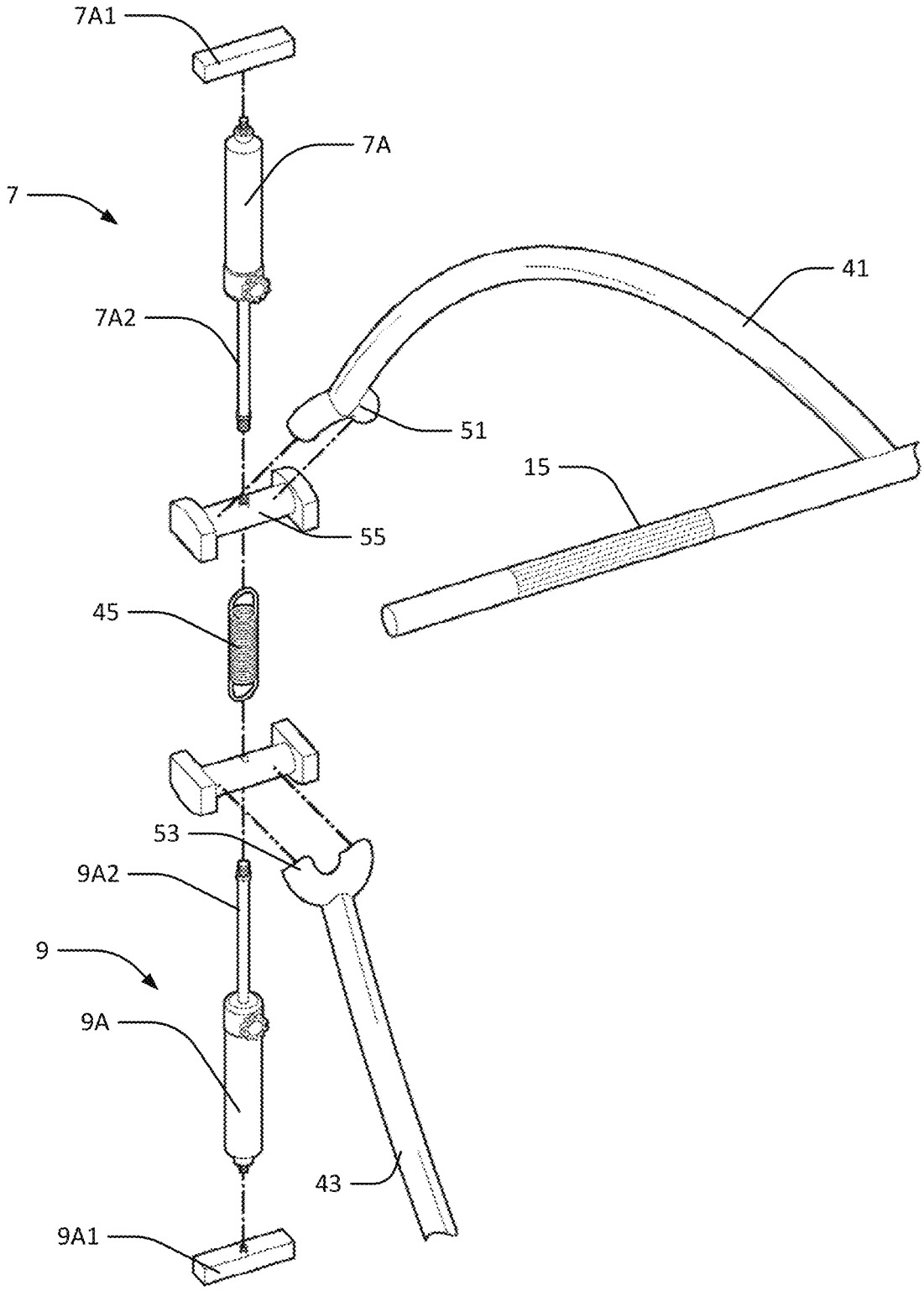
FIG. 6J shows an exploded view close-up of the central column resistance assembly interior components of the apparatus embodiment from FIG. 6A.

In FIG. 6J the interior upper and lower resistance assemblies are shown in an exposed view without the central column frame. Various components of the resistance assemblies 7 and 9 are identified including the resistance housing and 9A, resistance assembly mounts 7A1 and 9A1, resistance telescope 7A2 and 9A2. Also shown are the control arms 41 and 43, control arm mounts 51 and 53, control arm mount bars 55, and upper and lower grab bars 15.

Figure 6K:
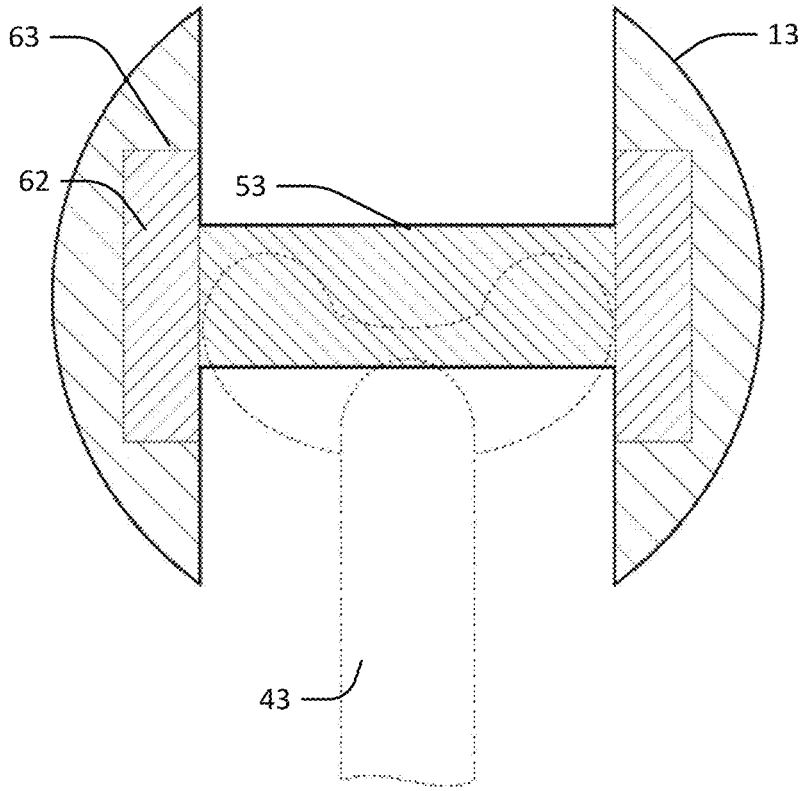
FIG. 6K shows the cross-section CC of the apparatus embodiment from FIG. 6A.

In FIG. 6K the cross-section CC of the central column 13 is shown. Various structures are shown including the control arm mount bar 55, lower control arm 43, control arm mount 53, sliding bar ends 62 and slots 63. As described above, the sliding bar ends slide vertically within the control bar slots 63. Each sliding bar end 62 is prevented from rotating by its vertically oriented straight edges within the slot 63.

Figure 7A:
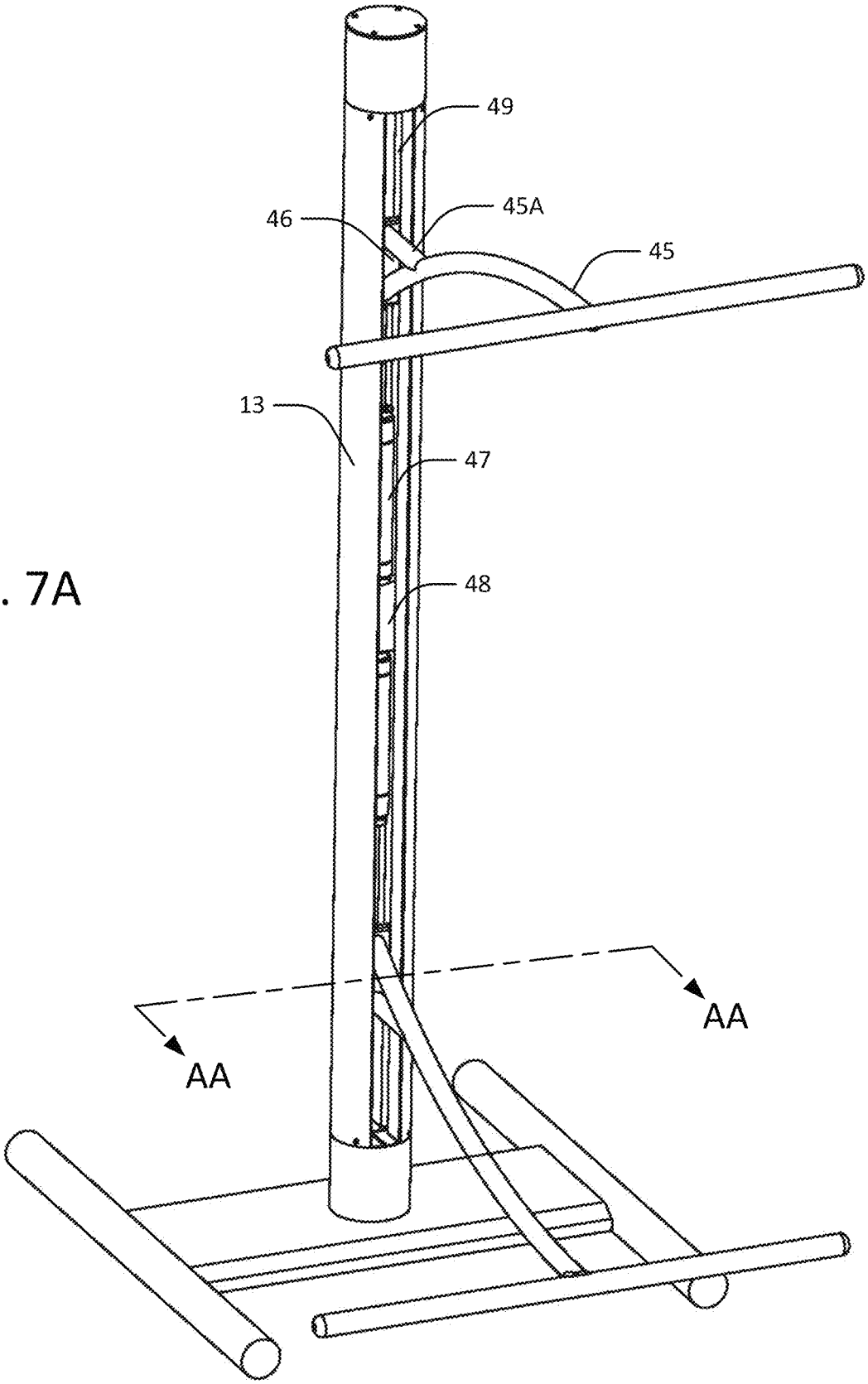
FIG. 7A shows a perspective view of an alternative embodiment utilizing a carriage assembly and track to provide stability and support for the control bars and cross-bars.

In an alternative embodiment, a rolling carriage assembly is utilized to provide a smooth vertical motion of the control and crossbars when the apparatus is in use. FIGS. 7A-7D show various views of this embodiment. FIG. 7A shows a perspective view of the full apparatus utilizing a rolling carriage assembly 46 and track 49 inside the central column 13. In this embodiment, a rolling carriage assembly 46 rolls vertically inside the central column 13, supported and guided by the carriage track 49. Also depicted in FIG. 7A are the resistance assembly 47, mounting block 48, control bar 45 and control bar support bracket 45A. The control bar 45 and control bar support bracket 45A are both attached by a fastener or are otherwise fixed to the rolling carriage assembly 46. The cross-section AA indicated in the diagram is detailed in FIG. 7D.

Figure 7B:
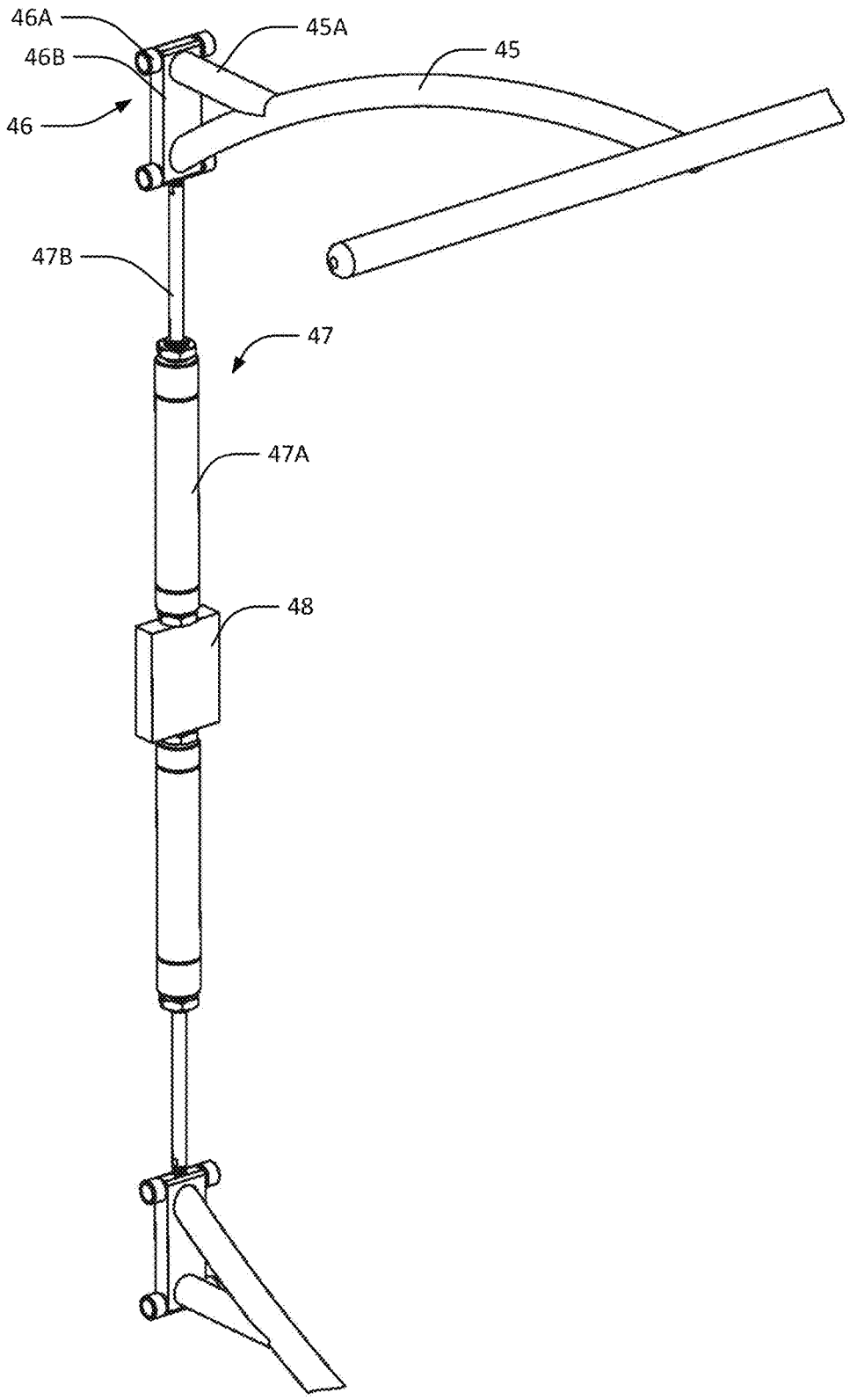
FIG. 7B shows the internal assembly structures of the embodiment from FIG. 7A.

FIG. 7B shows an exposed view of the rolling carriage assemblies, resistance assemblies, and mounting block 48, which are mounted inside the central column 13 and carriage track 49 which are not shown in this figure. The rolling carriage assembly 46 is shown as an internally rolling assembly with carriage rollers 46A and carriage frame 46B. Both the control bar 45 and control bar support bracket 45A are shown attached to the carriage frame 46B. The resistance assembly 47 as shown includes the resistance shaft 47B and resistance body 47A. In this embodiment, the rolling carriage assembly rolls vertically within the carriage track, shown in FIGS. 7B and 7E.

Figure 7C:
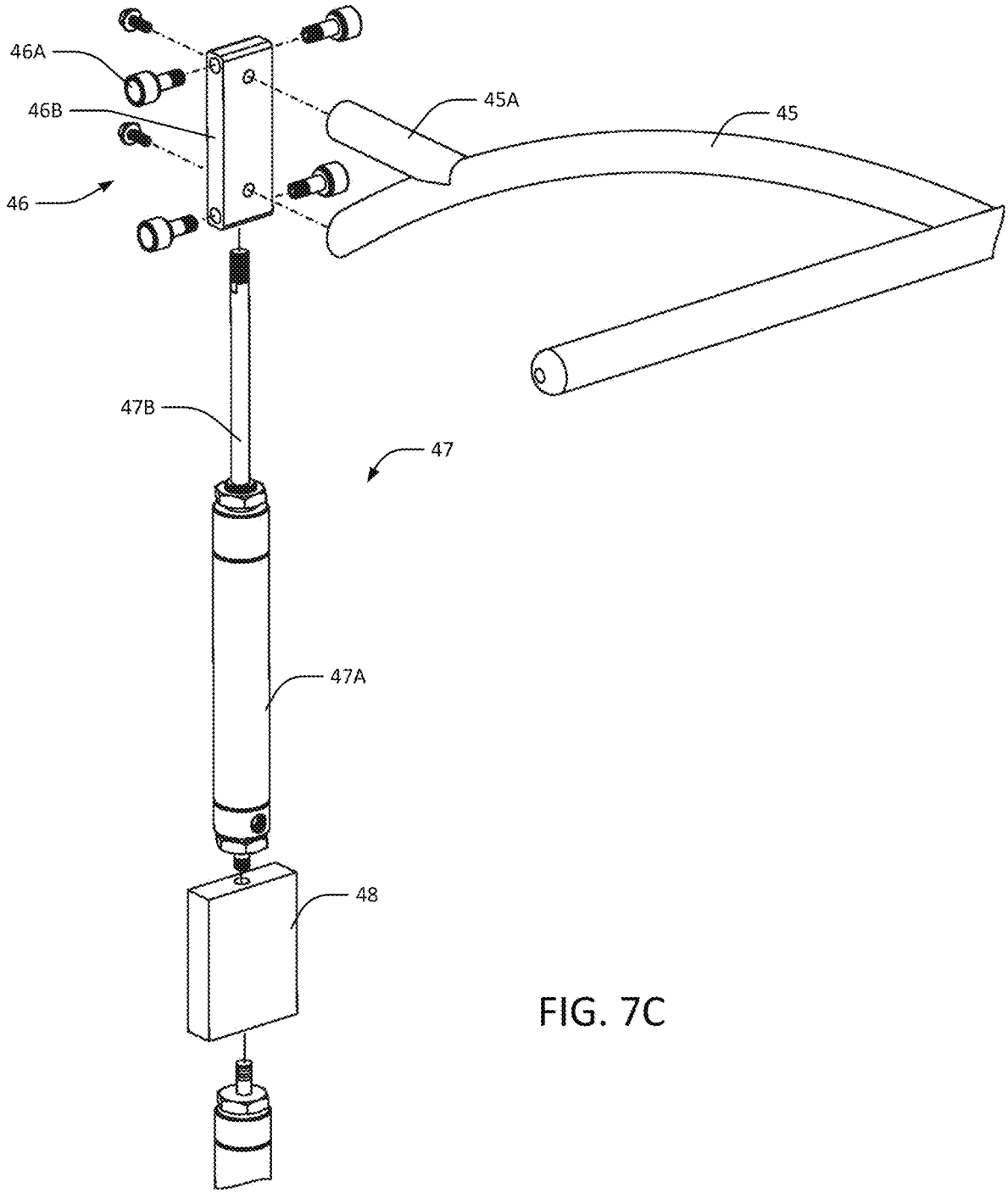
FIG. 7C shows an exploded view of the internal assembly structures of the embodiment from FIG. 7A.

FIG. 7C shows an exploded view of the rolling carriage assemblies, resistance assemblies, and mounting block 48. The rolling carriage assembly 46 is shown as an internally rolling assembly with carriage rollers 46A and carriage frame 46B. Both the control bar 45 and control bar support bracket 45A are shown attached to the carriage frame 46B with control bar fastener 46C. The resistance assembly 47 as shown includes the resistance shaft 47B and resistance body 47A. In this embodiment, the rolling carriage assembly rolls vertically within the carriage track, shown in FIGS. 7B and 7E. The mounting block 48 fixes the shown internal structures to the central column.

Figure 7D:
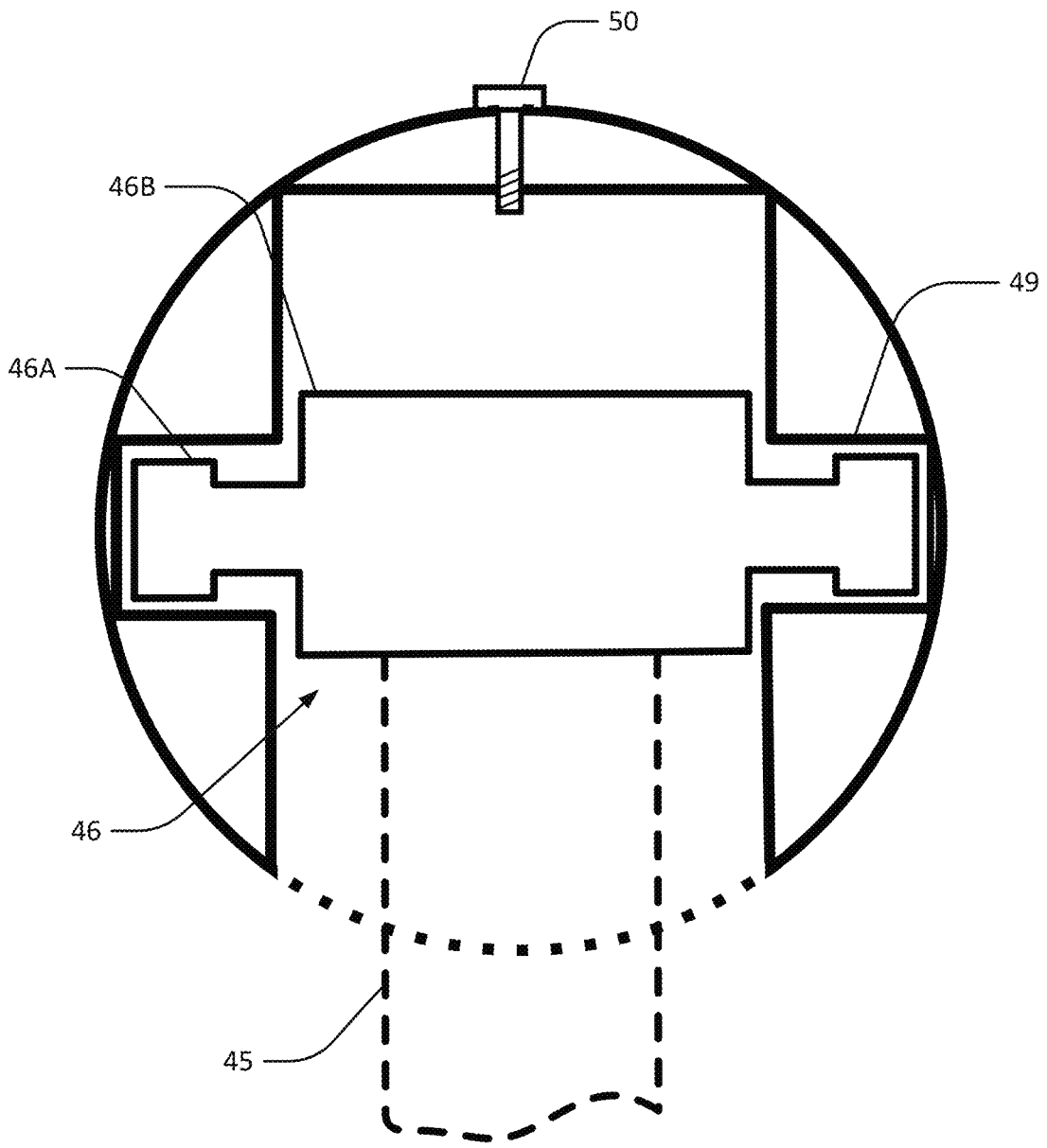
FIG. 7D shows a cross section of the carriage assembly and track of the embodiment from FIG. 7A.
Figure 7E:
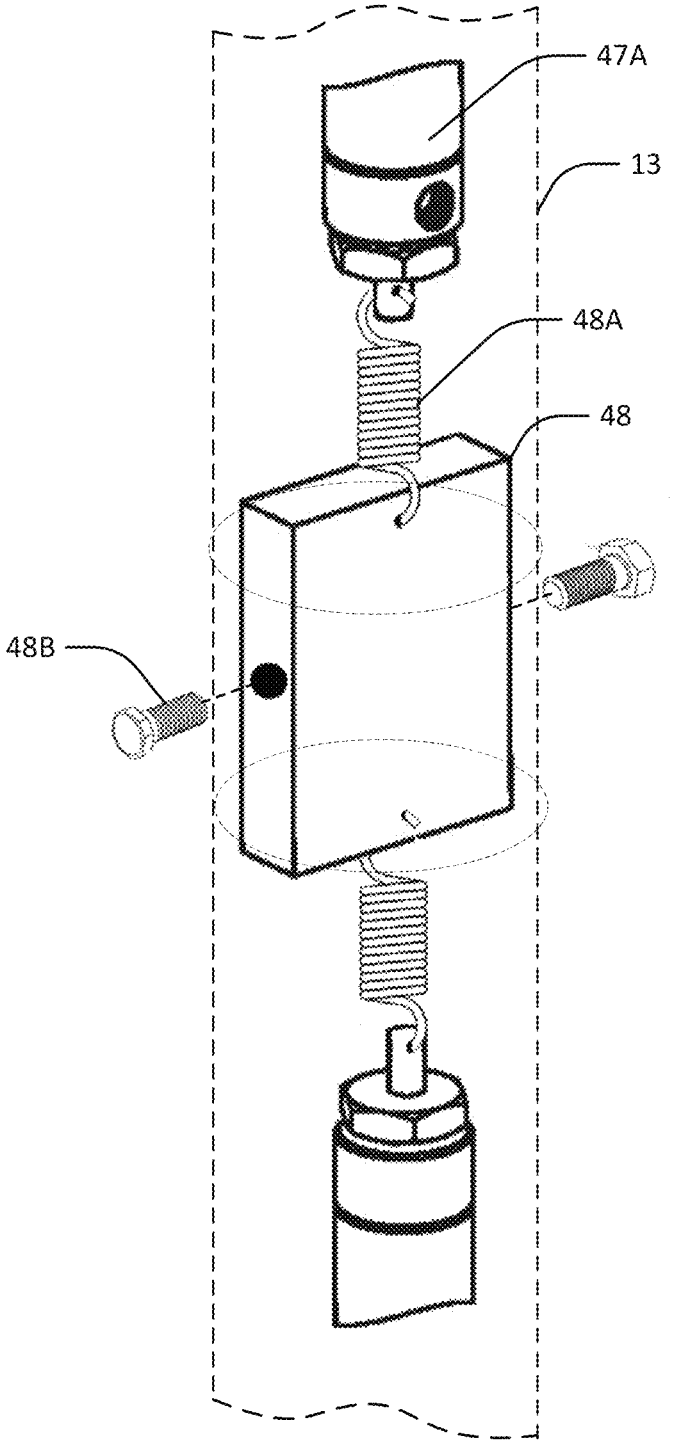
FIG. 7E shows an exemplar alternate version of the embodiment from FIG. 7A which includes upper and lower extension springs fixed to the central column and connected to the resistance assemblies.

FIG. 7D shows the cross-sectional view of section AA of the central column through rolling carriage assembly. In this view, an exemplar version of the carriage track 49 is shown which provides a frame to contain the rolling carriage assembly 46 for rolling vertically within the central column 13. In this version, the carriage track is fixed to the central column with fasteners 50. Not shown, the mounting block is fixed to the central column by a bracket or fastener. Two pairs of carriage rollers 46A are fixed in various versions of this embodiment by a threaded mounting portion to the carriage frame 46B. As shown in FIG. 7D, the control bar and control bar support bracket 45A are fixed to the carriage frame 46B with fasteners 45C. In alternative embodiments which utilize a rolling carriage, the central column has a square of rectangular cross-sectional shape. In additional alternative embodiments, the rolling carriage utilizes a track where the rollers bear against a track portion interior to the rollers. In additional embodiments, springs are attached to the rolling carriage assemblies and distal portions or end caps of the central column such that when in a resting condition, the cross bars are in the distally extended position (the top bar is at its highest point, the bottom bar at its lowest point). In additional embodiments, a spring is attached between the rolling carriage assemblies such that in a resting condition, the cross bars are in the proximal or central position (the top bar is at its lowest point, the bottom bar at its highest point). In various versions of this embodiment, the upper and lower cross bars have integrated hand grip and foothold fixtures, respectively.

In an alternative version of the embodiment from FIGS. 7A-7D, upper and lower extension springs are utilized for both static resistance to extension motion and to return the cross bars to a central resting position. In FIG. 7B, the ends of the upper and lower resistance assemblies inside the central column 13 are shown. As shown, each upper and lower resistance component bodies 47A are shown linked to the central column 13 by the extension springs 48A. The mounting block 48 is mounted to the central column by mounting fasteners 48B.

In various alternative embodiments of the apparatus, accessory components are integrated into the assembly. In one such version, sensors embedded in the grasp bar as the electrophysiologic transducer and signals corresponding to the heart rate are transmitted to a sent to a processing unit in the central post structure and may be displayed, utilized as part of a cardio exercise program, and/or transmitted to a phone app wirelessly by Bluetooth or wife wireless connection. In another accessory version, transcutaneous electrical nerve stimulation (TENS) is utilized to enhance muscle conditioning and/or to mitigate the perception of pain felt during conditioning. Application points for the TENS transducers may be placed in the upper "grasp" cross bar and lower foot hold cross bar or may be placed on other contact points of the user's body for TENS stimulation during conditioning or exercising.

In other embodiments which include accessory components in the apparatus, a display mounted to the apparatus is utilized to show conditioning or training video, device settings and heart rate monitoring.

Although the apparatus is not tied to any specific dimensions, in an exemplar version, the upper grasp cross bar and lower foot hold cross bar are separated by approximately 60 inches, enabling a person ranging from 5 feet 0 inches and 6 feet 4 inches to use the apparatus. In one instance, to use the apparatus for conditioning, a person steps into the footholds on the lower cross bar, and then grasps the upper cross bar. Conditioning is performed by pushing up with the user's arms against the cross bar, and down with the user's feet against the lower cross bar. This exercise is then performed in reverse, pulling down on the upper cross bar and pulling up with feet in the foot holds on the lower cross bar.

The various apparatus embodiments all share a common advantage of providing users a capability to simultaneously perform an exercise which conditions their arms, legs, torso, core, abdominal muscles, back muscles, shoulders and also provides cardiac conditioning.

The terminology used herein is for the purpose of describing particular embodiments only and is not intended to be limiting of the embodiments of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. Furthermore, to the extent that the terms "includes", "having", "has", "with", "comprised of", or variants thereof are used in either the detailed description or the claims, such terms are intended to be inclusive in a manner similar to the term "comprising."

While the invention has been illustrated by a description of various embodiments and while these embodiments have been described in considerable detail, it is not the intention of the applicants to restrict or in any way limit the scope of the appended claims to such detail. Additional advantages and modifications will readily appear to those skilled in the art. The invention in its broader aspects is therefore not limited to the specific details, representative methods, and illustrative examples shown and described. Accordingly, departures may be made from such details without departing from the spirit or scope of applicant's general inventive concept.

The invention claimed is:

1. A stand-up exercise apparatus comprising:

an upper crossbar;

a lower crossbar;

an upper control arm;

a lower control arm;

an upper resistance assembly;

a lower resistance assembly;

a central column;

a base;

wherein the upper crossbar and the lower crossbar are oriented parallel to a floor and are fixed to a front portion of the respective upper and lower control arms;

wherein the upper and lower control arms restrict motion of the upper and lower crossbars to a vertically oriented motion and wherein a rear portion of each of the upper and lower control arms is connected by a link to a first connection point on each of the upper and lower resistance assemblies;

wherein the upper and lower resistance assemblies are affixed to the central column by a second connection point on each of the upper and lower resistance assemblies;

wherein the upper crossbar provides a graspable location and the lower crossbar provides a foot-holding location; and whereby the vertically oriented motions of the upper crossbar and lower crossbar when pushed apart and pulled together is resisted by the stand-up exercise apparatus.

2. The stand-up exercise apparatus of claim 1, wherein the upper and lower control arms are connected to the central column by pivot points, wherein the respective front portion of each of the upper and lower control arms is on a front side of the respective pivot point and the respective rear portion of each of the upper and lower control arms is on a rear side of the pivot point.

3. The stand-up exercise apparatus of claim 2, wherein the front portions of the upper and lower control arms are attached to the upper and lower crossbars at a first connection point; and wherein the rear portions of the upper and lower control arms are attached to the upper and lower resistance assemblies at a second connection point.

4. The stand-up exercise apparatus of claim 3, wherein the rear portion of the lower control arm is connected to a first end of an auxiliary resistance extension spring and a second end of the auxiliary resistance extension spring is connected to the central column;

whereby the auxiliary resistance extension spring urges the lower control towards a resting position.

5. The stand-up exercise apparatus of claim 1, wherein the upper and lower control arms are connected to the central column by a bearing affixed to an end of each of the upper and lower control arms and coupled to a vertical slot portion of the central column wherein the bearing is configured to allow vertical motions of the upper and lower control arms to the bearing, and wherein the bearing is configured to restrict rotation of the upper and lower control arm within the vertical slot portion of the central column with respect to an axis orthogonal to the central column.

6. The stand-up exercise apparatus of claim 5 wherein the upper and lower resistance assemblies each comprise a dual action linear hydraulic damper.

7. The stand-up exercise apparatus of claim 6 wherein the upper and lower resistance assemblies each also comprise an integrated compression spring.

8. The stand-up exercise apparatus of claim 6 wherein the upper and lower resistance assemblies are coaxial with the central column.

9. The stand-up exercise apparatus of claim 6 wherein each of the dual action linear hydraulic dampers has an adjustable damping resistance control mechanism.

10. The stand-up exercise apparatus of claim 6 wherein the upper and lower resistance assemblies are connected to one another by an extension spring, wherein each end of the extension spring is affixed to one of the upper and lower resistance assemblies, and whereby the extension spring urges the resistance assemblies towards each other.

11. The stand-up exercise apparatus of claim 6 wherein the upper crossbar comprises a sensor capable of detecting one or more circulatory parameters during physical contact with a user.

12. The stand-up exercise apparatus of claim 6 wherein at least one of the upper crossbar or the lower crossbar comprises an electrical transducer capable of delivering transcutaneous electrical nerve stimulation (TENS).

13. The stand-up exercise apparatus of claim 1 wherein the upper and lower resistance assemblies each comprise a dual action linear hydraulic damper.

14. The stand-up exercise apparatus of claim 13 wherein the upper and lower resistance assemblies each also comprise an integrated compression spring.

15. The stand-up exercise apparatus of claim 13 wherein each of the dual action linear hydraulic dampers has an adjustable damping resistance control mechanism.

16. The stand-up exercise apparatus of claim 1 wherein the link to the first connection point on each of the upper and lower resistance assemblies comprises a rolling carriage assembly.

17. The stand-up exercise apparatus of claim 16 wherein each rolling carriage assembly comprises one or more pairs of rollers fixed to a carriage frame.

18. The stand-up exercise apparatus of claim 1 wherein the upper crossbar comprises a sensor capable of detecting one or more circulatory parameters during physical contact with a user.

19. The stand-up exercise apparatus of claim 1 wherein at least one of the upper crossbar or the lower crossbar comprises an electrical transducer capable of delivering transcutaneous electrical nerve stimulation (TENS) during physical contact with a user.

20. The stand-up exercise apparatus of claim 1 wherein the link to the first connection point on each of the upper and lower resistance assemblies comprises a carriage assembly.

21. A method for physical conditioning comprising the steps of:

standing on a lower crossbar of a vertically oriented fitness apparatus, wherein the lower crossbar is linked to a central column and a lower resistance assembly, wherein the lower resistance assembly is configured to be resistive proportionally to velocity;

grasping an upper crossbar of the vertically oriented fitness apparatus, wherein the upper crossbar is linked to a central column and an upper resistance assembly by an upper control bar and/or a lower control bar, wherein the upper resistance assembly is configured to be resistive proportionally to velocity;

pushing the upper crossbar and lower crossbar apart and pulling the upper crossbar and lower crossbar towards each other.

22. The method of claim 21 wherein an end of each of the upper control bar and the lower control bar is connected by an extension spring which urges the upper control bar and the lower control bar towards each other and a resting position.

* * * * *